US009920884B2

(12) United States Patent
Makinson et al.

(10) Patent No.: US 9,920,884 B2
(45) Date of Patent: Mar. 20, 2018

(54) AUTOMATED GAS CANISTER FILLER

(71) Applicant: GLOBALFORCE IP LIMITED, Auckland (NZ)

(72) Inventors: Ian Douglas Makinson, Auckland (NZ); Peter David Lucas, Auckland (NZ)

(73) Assignee: GlobalForce IP Limited, Auckland (NZ)

( * ) Notice: Subject to any disclaimer, the term of this patent is extended or adjusted under 35 U.S.C. 154(b) by 655 days.

(21) Appl. No.: 14/378,725

(22) PCT Filed: Feb. 26, 2013

(86) PCT No.: PCT/IB2013/051521

§ 371 (c)(1),
(2) Date: Aug. 14, 2014

(87) PCT Pub. No.: WO2013/128367

PCT Pub. Date: Sep. 6, 2013

(65) Prior Publication Data

US 2015/0020917 A1 Jan. 22, 2015

Related U.S. Application Data

(60) Provisional application No. 61/604,652, filed on Feb. 29, 2012.

(51) Int. Cl.

| | |
|---|---|
| ***F17C 13/02*** | (2006.01) |
| ***F17C 5/02*** | (2006.01) |
| ***F17C 5/06*** | (2006.01) |

(52) U.S. Cl.

CPC ..... *F17C 13/023* (2013.01); *F17C 5/02* (2013.01); *F17C 5/06* (2013.01); *F17C 2201/0109* (2013.01); *F17C 2201/058* (2013.01); *F17C 2205/0332* (2013.01); *F17C 2221/013* (2013.01); *F17C 2221/031* (2013.01); *F17C 2223/0123* (2013.01); (Continued)

(58) Field of Classification Search

CPC ... F17C 5/02; F17C 13/023; F17C 2250/0421

USPC ..... 141/83

See application file for complete search history.

(56) References Cited

U.S. PATENT DOCUMENTS

| | | | |
|---|---|---|---|
| 3,347,325 | A | 10/1967 | Espenschied |
| 4,655,029 | A | 4/1987 | Weiss |

(Continued)

FOREIGN PATENT DOCUMENTS

| | | | |
|---|---|---|---|
| EP | 0220193 | B1 | 5/1987 |

OTHER PUBLICATIONS

"Carbon Dioxide (CO2) Fire Extinguishers," Safety-Marine Ltd, Southampton, UK (Apr. 11, 2009).

(Continued)

*Primary Examiner* — Timothy L Maust
*Assistant Examiner* — Timothy P Kelly
(74) *Attorney, Agent, or Firm* — Frederick H. Gribbell

(57) ABSTRACT

A device for filling a small portable pressure vessel from a larger pressure vessel with a compressed fluid such as carbon dioxide. The device comprises an inlet adapted to receive fluid from a pressurized source, and an outlet adapted to connect to a pressure vessel. Between the inlet and the outlet there is a fill valve and a vent valve and at least one cam shaft configured to rotate and operate the valves.

6 Claims, 5 Drawing Sheets

(52) U.S. Cl.
CPC ..... *F17C 2223/0153* (2013.01); *F17C 2225/0123* (2013.01); *F17C 2225/0153* (2013.01); *F17C 2250/0421* (2013.01); *F17C 2250/075* (2013.01); *F17C 2260/032* (2013.01); *F17C 2270/01* (2013.01)

(56) References Cited

U.S. PATENT DOCUMENTS

| | | | | |
|---|---|---|---|---|
| 5,456,297 | A | 10/1995 | Crossdale | |
| 5,682,930 | A | 11/1997 | Crossdale | |
| 5,887,609 | A | 3/1999 | Garretson | |
| 5,896,898 | A | 4/1999 | Crossdale | |
| 6,152,192 | A * | 11/2000 | Klotz ..... | F17C 5/002 141/104 |
| 6,588,466 | B1 | 7/2003 | Lohr | |
| 8,636,040 | B2 * | 1/2014 | Deck ..... | G05D 11/132 141/54 |

OTHER PUBLICATIONS

WO 2013/128367 A1 (instant PCT application) with International Search Report, dated Sep. 6, 2013.
Written Opinion of the International Searching Authority, dated Jun. 21, 2013.
International Search Report, dated Jun. 21, 2013.

* cited by examiner

AUTOMATED GAS CANISTER FILLER

CROSS-REFERENCE TO RELATED APPLICATIONS

The present application is a National Stage filing of PCT/IB2013/051521, filed International Stage on Feb. 26, 2013; and claims priority to U.S. provisional patent application 61/604,652, filed on Feb. 29, 2012.

FIELD OF THE INVENTION

The present invention relates to an apparatus and method of filling a smaller pressurized gas vessel from a larger pressurized gas source. More particularly, the larger pressurized gases source is preferably a pressurized gas vessel. More particularly still, the method and apparatus are semi autonomous and/or easily portable.

BACKGROUND TO THE INVENTION

Pneumatic power systems are used in a variety of applications, and particularly with regard to tools. Traditionally, pneumatic tools have been designed to be connected to a source of compressed air, such as a stationary air compressor. More recently, portable pressure sources have been developed by which a small vessel containing a pressurised fluid, such as carbon dioxide, may be connected via a regulator to a tool. These systems allow the tools to be used in a more portable fashion without being restricted by the long hosing requirements of conventional set ups.

In this type of portable device, the mass of fluid stored in the vessel in order to power the device must be sufficient for a practical number of operations, but not so large that portability suffers unduly. As a result, it may be necessary to change the portable canisters, or re-fill them relatively often.

Other examples of pneumatic devices (generally referred to as a "motion transfer devices") may be a hammer drill, jack hammer, grinder, nail gun or paintball gun, or any other device known to be driven pneumatically.

For these portable pneumatic applications, preferably, the driving fluid is carbon dioxide, which is inexpensive and non flammable. Further, carbon dioxide may be stored in the liquid phase at attainable pressure, thereby allowing for a larger mass to be stored within a limited space. In cases where carbon dioxide is used, this means that at room temperature, the vessel will preferably contain both liquid and gaseous carbon dioxide, (at a pressure of typically 750 psi or thereabouts for example).

It should be appreciated that the driving fluid may not be carbon dioxide. The driving fluid could be any other fluid with properties suited to the particular application. However, due to potential venting of the apparatus to atmosphere, it is highly preferred that the driving fluid is non-flammable.

Traditionally, there are two types of filling systems for filling a small portable pressure vessel with a fluid like carbon dioxide for example. Firstly, there are large scale filling plants that invariably use a high pressure pump to force the carbon dioxide into the portable pressure vessel (while maintaining a safe vapour space above the liquefied $CO_2$ in the small canister). These systems are typically closed, and do not allow any gas to escape to the atmosphere.

The second type of system is typically used on a smaller scale, where the portable canisters are filled onsite for example. In these situations, a larger pressurised $CO_2$ bottle is used to fill smaller portable pressure vessels. In this type of setup, the filling is done entirely manually by opening and closing the respective bottle valves until the desired weight of the portable canister is achieved. The driving force to transfer the $CO_2$ comes from the pressure differential and not a pump.

A manual filling system while simple, requires the user to know what they are doing in order to avoid large wastage, and/or dangerous overfill conditions as well as achieving sufficient fill weight.

The present method and apparatus provides a semi-autonomous system that is small and portable and goes at least some way to mitigating one or more of the above problems or at least provides a useful choice.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY OF THE INVENTION

In one aspect, the present invention broadly consists in a filling apparatus for filling a pressure vessel with fluid comprising:

- an inlet adapted to receive fluid from a pressurized source,
- an outlet adapted to connect to a pressure vessel, and a fluid pathway between said inlet and said outlet,
- a fill valve located in said path between said inlet and said outlet,
- a vent valve located in said path between said fill valve and said outlet,
- at least one cam shaft configured to rotate and operate said fill valve and said vent valve.

According to another aspect rotation of said at least one cam shaft causes opening and closing of the respective fill valve and/or vent valve, but forces from the valves acting on the cam shaft cannot rotate the cam shaft due to high gearing.

According to another aspect said fill valve and said vent valve are operated by the same cam shaft.

According to another aspect said cam shaft at least one cam shaft includes cam surfaces configured to operate said fill valve and said vent valve respectively, and said shaft has at least the following angular positions with corresponding valve conditions:

- i) a filling position with the fill valve open and vent valve closed,
- ii) a venting position with the fill valve closed and the vent valve open.

According to another aspect said shaft has at least the following additional angular positions with corresponding valve conditions:

- iii) a filling stop position with the fill valve closed and the vent valve closed,
- said filling stop position located between said filling position and said venting position.

According to another aspect said shaft includes two angular positions corresponding with a filling stop position with the fill valve closed and the vent valve closed.

According to another aspect each said angular position is located 90 degrees from the last.

According to another aspect said cam shaft is coupled to (directly or indirectly), and rotated by, an electric motor.

According to another aspect said apparatus further comprises:

a weighing arm displaceable under the weight of said pressure vessel and a sensor configured to output a weight signal indicative of the weight of said pressure vessel acting on said arm.

According to another aspect said apparatus further comprises:

a controller operationally coupled to said motor and adapted to receive said signal from said sensor.

According to another aspect said pressure vessel is flexibly suspended from said weighing arm.

According to another aspect said pressure vessel is flexibly suspended from said weighing arm by a flexible fill hose.

According to another aspect said controller includes an initial vent cycle wherein:

the controller causes the motor to move the cam shaft to a venting position with the fill valve closed and the vent valve open, and the controller monitors said weight signal over time, and if a change in said weight signal indicates the rate of change of weight is below a first predetermined threshold, said controller causes the motor to move the cam shaft to close said vent valve and initiate a filling cycle.

According to another aspect said first predetermined threshold is between 0.001 and 10.0 g/sec.

According to another aspect said first predetermined threshold is between 0.05 and 5.0 g/sec.

According to another aspect during said initial vent cycle the controller causes the motor to move the cam shaft to close said vent valve and outputs an error signal, if said first predetermined threshold is not reached before a second predetermined threshold.

According to another aspect said controller does not allow the fill valve to be opened, unless a predetermined reset criteria is met.

According to another aspect said reset criteria requires a user to remove the pressure vessel from the filling apparatus.

According to another aspect said second predetermined threshold is a time limit.

According to another aspect said second predetermined threshold is dependent on an indicated size of the pressure vessel.

According to another aspect said time limit is approximately 30 seconds.

According to another aspect said second threshold is a predetermined decrease in weight of the pressure vessel.

According to another aspect said second predetermined threshold is dependent on an indicated size of the pressure vessel.

According to another aspect said second threshold is between 10% and 30% of the pressure vessel fill weight.

According to another aspect said controller includes a fill cycle wherein:

the controller causes the motor to move the cam shaft to a fill position with the fill valve open and the vent valve closed, and the controller monitors said weight signal over time, and if a change in said weight signal indicates the rate of change of weight is below a third predetermined threshold, said controller causes the motor to move the cam shaft to close said fill valve and initiate a pressure venting cycle.

According to another aspect said third predetermined threshold is between 0.1 and 10 g/sec.

According to another aspect said third predetermined threshold is between 0.5 and 5.0 g/sec.

According to another aspect during said pressure vent cycle the controller causes the motor to move the cam shaft to open said vent valve, until a fourth predetermined threshold criteria is met.

According to another aspect said fourth predetermined threshold is a time limit.

According to another aspect said fourth predetermined threshold is dependent on an indicated size of the pressure vessel.

According to another aspect said time limit is approximately 30 seconds.

According to another aspect said fourth threshold is a predetermined decrease in weight of the pressure vessel.

According to another aspect said fourth predetermined threshold is dependent on an indicated size of the pressure vessel.

According to another aspect said fourth threshold is between approximately 2% and 5% of the vessel fill weight.

According to another aspect said controller causes the motor to move the cam shaft to said fill position with the fill valve open and the vent valve closed, after said fourth threshold is reached.

According to another aspect said controller causes said apparatus to execute a plurality of vent then fill cycles while the pressure vessel weight remains below a predetermined fill weight.

According to another aspect said controller causes the motor to move the cam shaft to close said fill valve, open said vent valve, and outputs an error signal, if the pressure vessel weight remains below a said predetermined fill weight after a predetermined number of fill then vent cycles.

According to another aspect said predetermined number of fill then vent cycles is between 3 and 10 vent then fill cycles.

According to another aspect said apparatus further comprises a user interface configured to allow a user to operate the apparatus.

According to another aspect said user interface allows a user to select a size of the pressure vessel to be filled that is stored in memory.

According to another aspect said user interface allows a user to choose a unique identifier associated with a pressure vessel to be filled.

According to another aspect said controller does not allow filling of said pressure vessel, without first executing an initial vent cycle , unless selection of a said a unique identifier is made.

According to another aspect said user interface allows a user to choose a pre-set pressure vessel fill weight.

According to another aspect the invention broadly consists in a filling apparatus for filling a pressure vessel with fluid, comprising:

an inlet adapted to receive fluid from a pressurized source, an outlet adapted to connect to a pressure vessel, and a fluid pathway between said inlet and said outlet, a fill valve located in said path between said inlet and said outlet, a vent valve located in said path between said fill valve and said outlet, a controller operationally coupled to said fill valve and said vent valve, and adapted to receive a signal from a sensor indicative of the weight of said vessel, and said controller includes an initial vent cycle wherein:

the controller causes the fill valve to close and the vent valve to open, and the controller monitors said weight signal over time, and if a change in said weight signal indicates the rate of change of weight is below a first predetermined threshold, said controller causes the vent valve to close and the fill valve to open to initiate filling said vessel.

According to another aspect said apparatus further includes a weighing arm displaceable under the weight of said pressure vessel and said sensor is configured to output a weight signal indicative of the weight of said pressure vessel acting on said arm.

According to another aspect said first predetermined threshold is between 0.001 and 10.0 g/sec.

According to another aspect said first predetermined threshold is between 0.05 and 5.0 g/sec.

According to another aspect during said initial vent cycle the controller causes said vent valve to close, and outputs an error signal if said first predetermined threshold is not reached before a second predetermined threshold.

According to another aspect said controller does not allow the fill valve to be opened, unless a predetermined reset criteria is met.

According to another aspect said reset criteria requires a user to remove the pressure vessel from the filling apparatus.

According to another aspect said second predetermined threshold is a time limit.

According to another aspect said second predetermined threshold is dependent on an indicated size of the pressure vessel.

According to another aspect said time limit is approximately 30 seconds.

According to another aspect said second threshold is a predetermined decrease in weight of the pressure vessel.

According to another aspect said second predetermined threshold is dependent on an indicated size of the pressure vessel.

According to another aspect said second threshold is between 10% and 30% of the pressure vessel fill weight.

According to another aspect said controller includes a fill cycle wherein:

the controller causes the fill valve to open and the vent valve to close, and the controller monitors said weight signal over time, and if a change in said weight signal indicates the rate of change of weight is below a third predetermined threshold, said controller causes said fill valve to close and initiate a pressure venting cycle.

According to another aspect said third predetermined threshold is between 0.1 and 10 g/sec.

According to another aspect said third predetermined threshold is between 0.5 and 5.0 g/sec.

According to another aspect during said pressure vent cycle the controller causes the vent valve to open, until a fourth predetermined threshold criteria is met.

According to another aspect said fourth predetermined threshold is a time limit.

According to another aspect said fourth predetermined threshold is dependent on an indicated size of the pressure vessel.

According to another aspect said time limit is approximately 30 seconds.

According to another aspect said fourth threshold is a predetermined decrease in weight of the pressure vessel.

According to another aspect said fourth predetermined threshold is dependent on an indicated size of the pressure vessel.

According to another aspect said fourth threshold is between approximately 2% and 5% of the vessel fill weight.

According to another aspect said controller causes said fill valve to open and said vent valve to close, after said fourth threshold is reached.

According to another aspect said controller causes said apparatus to execute a plurality of vent then fill cycles while the pressure vessel weight remains below a predetermined fill weight.

According to another aspect said controller causes said fill valve to close, said vent valve to open and outputs an error signal, if the pressure vessel weight remains below a said predetermined fill weight after a predetermined number of fill then vent cycles.

According to another aspect said predetermined number of fill then vent cycles is between 3 and 10 vent then fill cycles.

According to another aspect said apparatus further comprises a user interface configured to allow a user to operate the apparatus.

According to another aspect said user interface allows a user to select a size of the pressure vessel to be filled that is stored in memory.

According to another aspect said user interface allows a user to choose a unique identifier associated with a pressure vessel to be filled.

According to another aspect said controller does not allow filling of said pressure vessel, without first executing an initial vent cycle, unless selection of a said a unique identifier is made.

According to another aspect said user interface allows a user to choose a pre-set pressure vessel fill weight.

According to another aspect the invention broadly consists in a filling apparatus for filling a pressure vessel with fluid, comprising:

an inlet adapted to receive fluid from a pressurized source, an outlet adapted to connect to a pressure vessel, and a fluid pathway between said inlet and said outlet, a fill valve located in said path between said inlet and said outlet, a vent valve located in said path between said fill valve and said outlet, a controller operationally coupled to said fill valve and said vent valve, and adapted to receive a signal from a sensor indicative of the weight of said vessel, and said controller includes a fill cycle wherein:

the controller causes the fill valve to open and the vent valve to close, and the controller monitors said weight signal over time, and if a change in said weight signal indicates the rate of change of weight is below a third predetermined threshold, said controller causes said fill valve to close and initiate a pressure venting cycle.

According to another aspect said third predetermined threshold is between 0.1 and 10 g/sec.

According to another aspect said third predetermined threshold is between 0.5 and 5.0 g/sec.

According to another aspect during said pressure vent cycle the controller causes the vent valve to open, until a fourth predetermined threshold criteria is met.

According to another aspect said fourth predetermined threshold is a time limit.

According to another aspect said fourth predetermined threshold is dependent on an indicated size of the pressure vessel.

According to another aspect said time limit is approximately 30 seconds.

According to another aspect said fourth threshold is a predetermined decrease in weight of the pressure vessel.

According to another aspect said fourth predetermined threshold is dependent on an indicated size of the pressure vessel.

According to another aspect said fourth threshold is between approximately 2% and 5% of the vessel fill weight.

According to another aspect said controller causes said fill valve to open and said vent valve to close, after said fourth threshold is reached.

According to another aspect said controller causes said apparatus to execute a plurality of vent then fill cycles while the pressure vessel weight remains below a predetermined fill weight.

According to another aspect said controller causes said fill valve to close, said vent valve to open and outputs an error signal, if the pressure vessel weight remains below a said predetermined fill weight after a predetermined number of fill then vent cycles.

According to another aspect said predetermined number of fill then vent cycles is between 3 and 10 vent then fill cycles.

According to another aspect said apparatus further comprises a user interface configured to allow a user to operate the apparatus.

According to another aspect said user interface allows a user to select a size of the pressure vessel to be filled that is stored in memory.

According to another aspect said user interface allows a user to choose a unique identifier associated with a pressure vessel to be filled.

According to another aspect said controller does not allow filling of said pressure vessel, without first executing an initial vent cycle, unless selection of a unique identifier is made.

According to another aspect said user interface allows a user to choose a pre-set pressure vessel fill weight.

According to another aspect said pressurized source is a second pressure vessel larger than said pressure vessel.

According to another aspect said pressurized source is not a high pressure pump.

According to another aspect the invention broadly consists in a filling method comprising:

- fluidly connecting a portable pressure vessel to a pressurized source,
- opening a vent valve to initiate fluid flow from said portable pressure vessel to atmosphere,
- monitoring the rate of change in weight of said portable pressure vessel,
- establishing a tare weight of said portable pressure vessel when said rate of change in weight of said portable pressure vessel is below a first predetermined threshold.

According to another aspect the invention broadly consists in a filling method comprising:

- fluidly connecting a portable pressure vessel to a pressurized source,
- opening a fill valve to initiate fluid flow from said pressurized source to said portable pressure vessel,
- monitoring the rate of change in weight of said portable pressure vessel,
- closing said fill valve and opening a vent valve, if said change in weight of said portable pressure vessel is below a third predetermined threshold.

According to another aspect the invention broadly consists in filling method including the apparatus of any one or more of clauses 1 to 96.

According to another aspect the invention broadly consists in filling apparatus substantially as herein described and with reference to any one or more of the drawings.

According to another aspect the invention broadly consists in filling method substantially as herein described and with reference to any one or more of the drawings.

DEFINITIONS

The term "comprising" as used in this specification and claims means "consisting at least in part of". When interpreting each statement in this specification and claims again that includes the term "comprising", features other than that or those prefaced by the term may also be present. Related terms such as "comprise" and "comprises" are to be interpreted in the same manner.

In this specification "semi-autonomous" means a system that requires a user to manually connect and disconnect a portable pressure vessel from the filling apparatus, but automatically controls the filling of the pressure vessel once connected.

In this specification the words "bottle", "canister", "container", and "pressure vessel" are used interchangeably to describe a portable pressure vessel to be filled from a larger source of pressurized fluid.

In this specification the word "fluid" means liquid and/or gas.

In this specification the "tare weight" of a pressure vessel is the weight of the vessel when empty. In this specification the "fill weight" of a pressure vessel is the weight of fluid ($CO_2$ for example) that is to be stored in the vessel. As a result, the "total weight" is the sum of the fill weight and the tare weight.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

Figure 1:
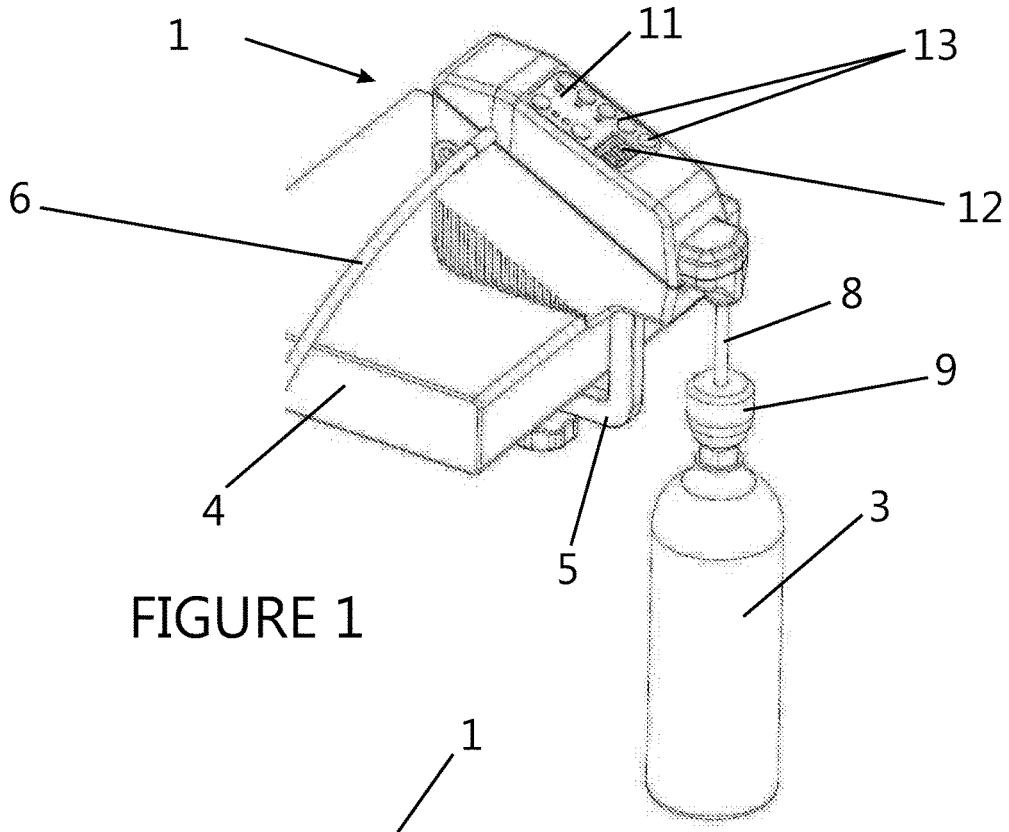
FIG. 1 is a perspective view of one embodiment of the canister filling apparatus shown mounted to a horizontal surface.
Figure 2:
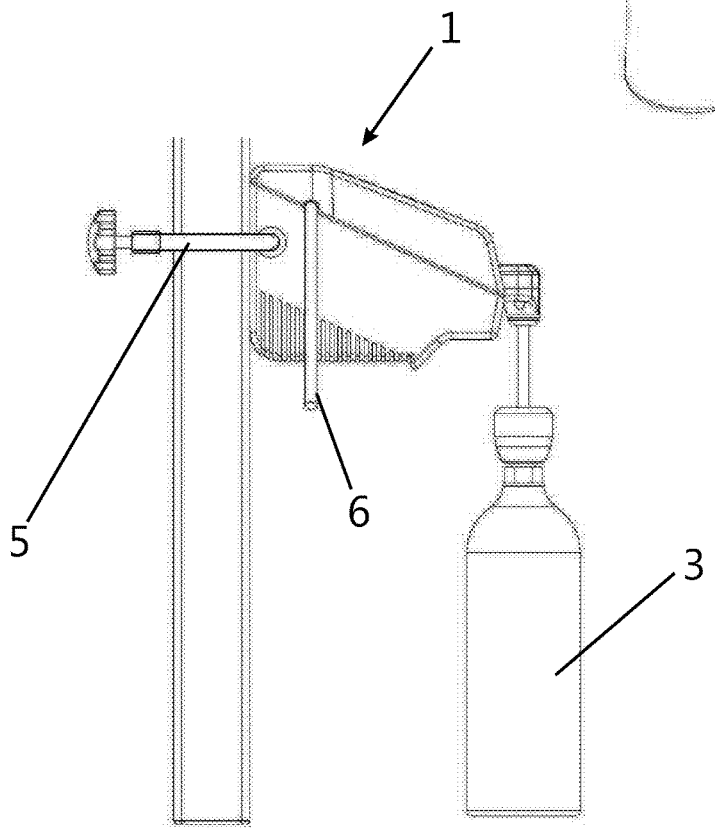
FIG. 2 is a side view of the filling apparatus mounted to a vertical pole.

While it is to be understood that the present invention relates broadly to any application where filling a smaller pressure vessel from a larger pressurized gases source is desirable, the most preferred fluid is $CO_2$. The following examples refer specifically to $CO_2$ supplied from a larger pressure vessel, which is where the present invention finds its most preferable application.

The pressure in a vessel that contains liquid and gaseous carbon dioxide is dependant on the temperature (rather than on the quantity of liquid in the vessel). For this reason the bottle must be weighed in order to determine the quantity of carbon dioxide within. The pressure within the vessel cannot be used as an accurate indication as it can with compressed gases with no liquid phase present.

In addition, if the temperature of the vessel rises, a critical point is reached where the pressure increases dramatically. For this reason the amount of liquid in the vessel is limited in order to leave a volume of gas into which the liquid can expand if it is heated. Typically a carbon dioxide canister has a recommended fill weight that gives approximately 34% of the volume as liquid. With this volume of liquid in the canister, the temperature can rise to 50 deg C. and the pressure will be limited to approximately 2000 psi.

The portable canister is also fitted with a burst disk which is typically set to vent at a pressure of approximately 2200 psi. The canisters are typically rated to approximately 3000 psi, so the burst disk gives a reasonable safety margin against failure.

As a portable vessel is filled, the pressure inside the portable vessel will increase rapidly. As the liquid forms in the portable vessel, the pressure within will be similar to the supply vessel if they are at a similar temperature. If the temperatures are equal, an equilibrium is reached and the filling will stop. This can occur well before the portable gas canister is as full as it could/should be.

To be able to transfer more liquid from the larger gas source bottle, it is necessary to lower the pressure of the portable vessel by lowering its temperature. This is done by venting off a small volume of liquid from the portable bottle to atmosphere. The latent heat required to evaporate the liquid is absorbed largely from the remaining liquid, resulting in the temperature of the liquid and the canister falling. In order to reach the desired fill weight in the portable canister, several fill-vent cycles may be required.

Typically a portable liquid carbon dioxide bottle will be marked with the fill weight but will not be marked with its tare weight. To fill such a bottle to its recommended weight, the bottle must first be emptied so that the weighing balance can be tared. The bottle can then be filled until the correct fill weight is reached.

However, a problem can arise with this method when venting a large volume of carbon dioxide from the portable canister. For example, during venting of the contents of the portable gas canister, so much heat is absorbed by the evaporating gas that the remaining liquid can freeze. Once the remaining liquid is frozen, the rate of venting falls dramatically, and may even cease.

If the liquid in the bottle freezes, it is necessary for the user to wait for the bottle to absorb sufficient heat for the solid carbon dioxide to melt. However, the user may think that the bottle is empty because very little gas will be venting (in this state, the venting flow rate is so slow that any hissing may have stopped). The user may then assume that the bottle is empty, tare the weighing balance, and then consequently over fill the bottle to a potentially dangerous state.

In order to address these issues, the present method and apparatus provide a semi-autonomous system that is particularly suited to portable applications.

FIG. 1 illustrates a filling system 1, with a portable pressure vessel 3 connected to it via filling hose 8. The filling hose 8 includes a hose fitting 9, for engaging with the pressure vessel 3 in a fluid tight manner as is known in the art. Typically, pressure vessel 3, includes a valve to prevent escape of the pressurized fluid through the pressure vessel opening. Preferably, hose fitting 9 includes a feature to open the valve as it engages with the pressure vessel 3, as is known in the art.

In FIG. 1, the filling system 1 is shown attached to a horizontal bench 4, by a clamp arrangement 5. High pressure fluid (preferably $CO_2$) is provided to the system through inlet hose 6. Preferably, the high pressure fluid source is a large pressure vessel (not shown). For example $CO_2$ is commonly available in 5-100 kg bottles that can be used to fill the smaller pressure vessels. Smaller portable pressure vessels are typically available in a range of 'standard' sizes e.g. 12, 20 and 40 Oz.

Figure 3:
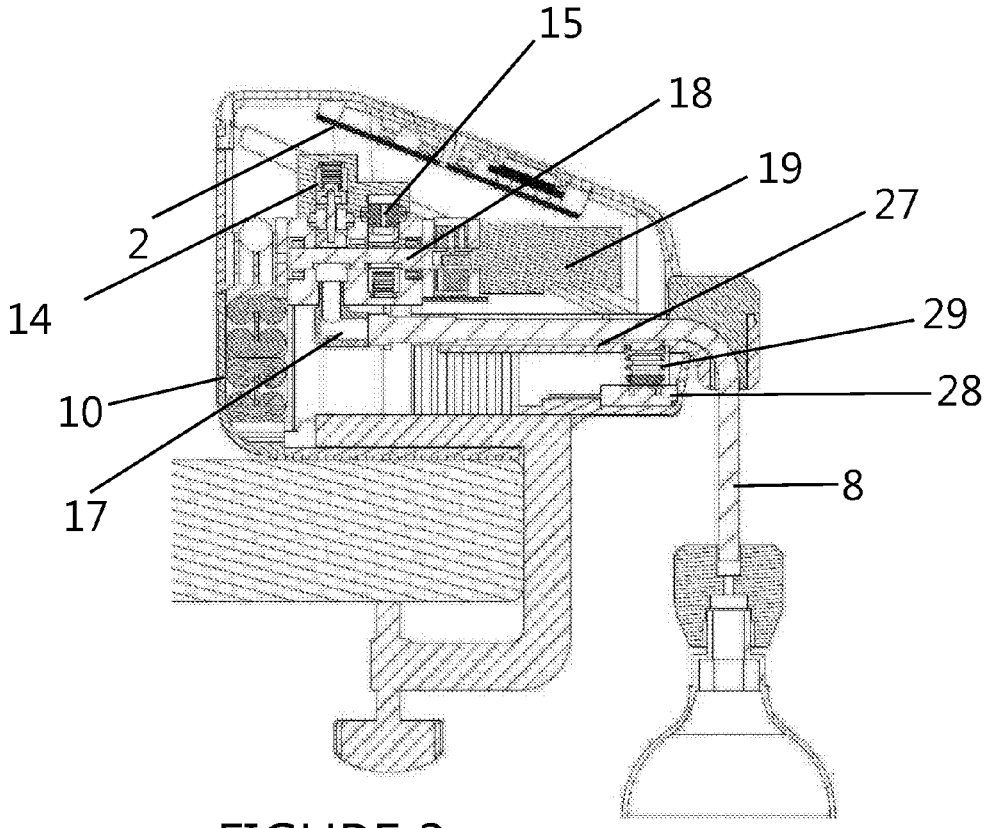
FIG. 3 is a cross-section view of the filling apparatus of FIG. 1.
Figure 4:
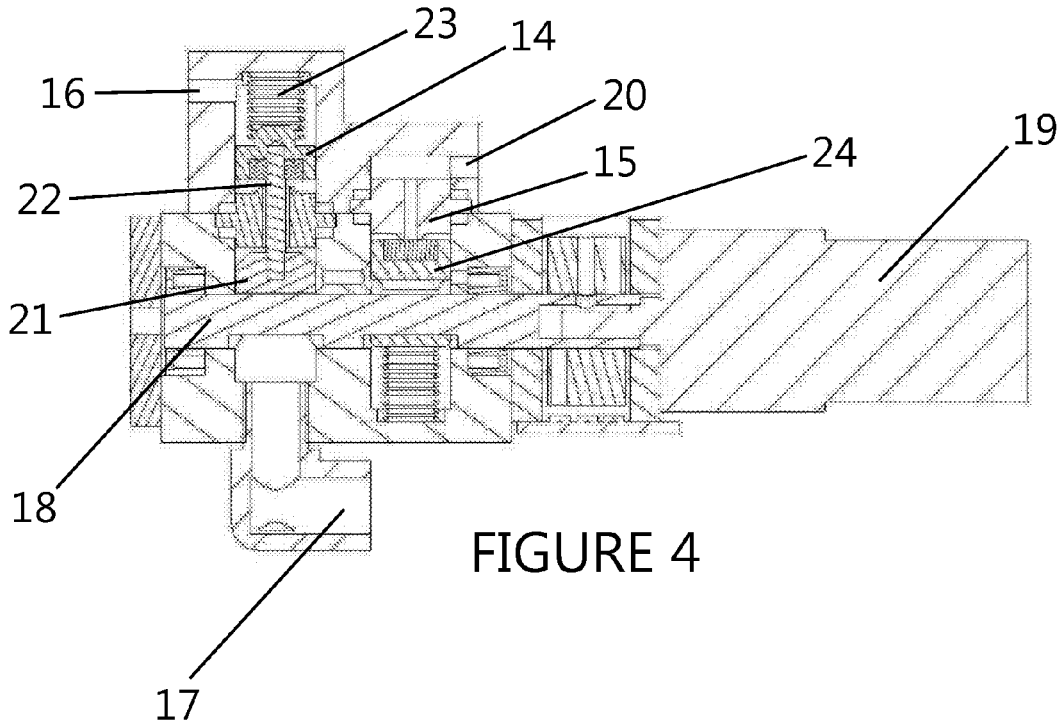
FIG. 4 is a detailed cross-section view of the valve arrangement of FIG. 3.
Figure 5:
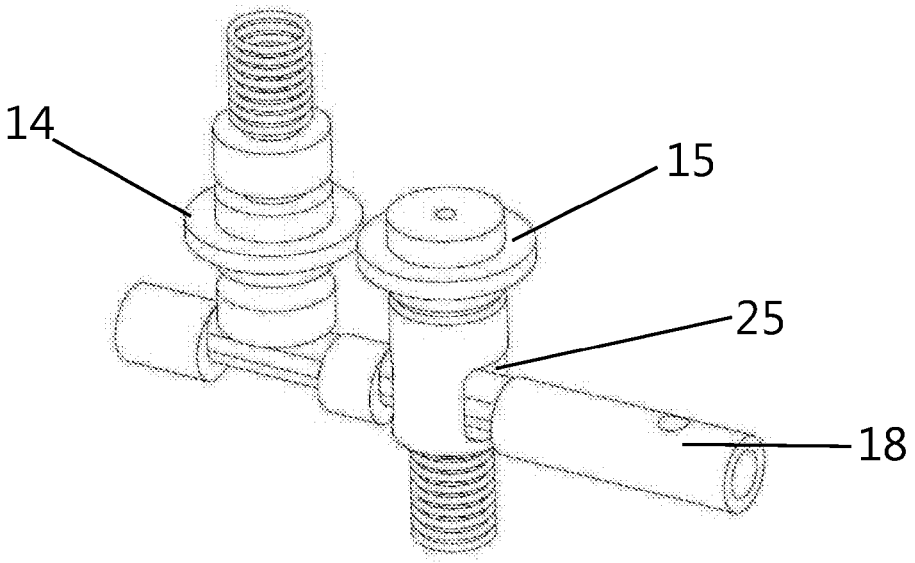
FIG. 5 is a detailed view of the valve arrangement of FIG. 4.
Figure 6:
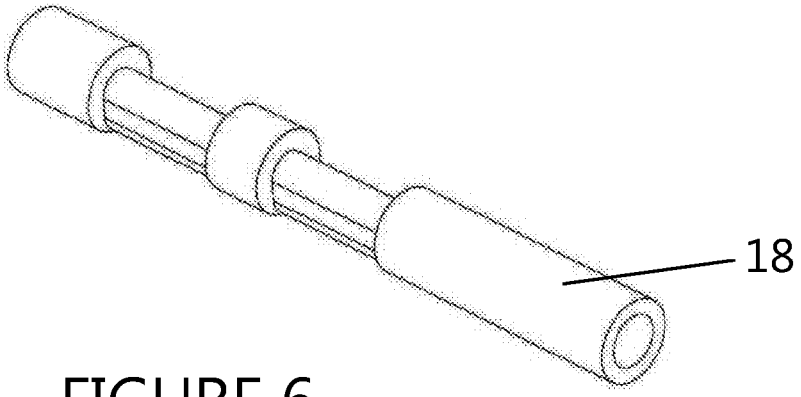
FIG. 6 is a perspective view of the cam of FIG. 5.

With particular reference to FIG. 3 and FIG. 4, further details of the filling system 1 will be described. Filling system 1 is preferably powered by battery 10, in order to improve the portability of the device and enable operation in locations where external power is not available or inconvenient. Alternatively, filling system 1 may accept power from an external source.

Controller 2, is provided to facilitate the operation of the autonomous features of filling system 1. A user interface 11, is operationally coupled with controller 2, to allow a user to select various operational parameters and operate the device. Preferably, the user interface 11, also includes a display 12 and or a plurality of user controls 13.

Filling system 1 includes a filling valve 14 and a vent valve 15 located in the fluid passageway between the filling system inlet 16 and the filling system outlet 17. The outlet side 20 of vent valve 15 is in communication (directly or indirectly) with the atmosphere and may include a noise suppression device (not shown) to reduce the noise of high pressure gas venting during use. It will be appreciated that the vent valve 15, is "in" the fluid passageway to the extent that it is in fluid communication with the primary passage between the inlet 16 and outlet 17. The direction and path of flow within the passageway will depend on the specific condition of valves 14 and 15, as described in more detail later.

Filling valve 14 and vent valve 15 are operated by cam shaft 18, which is in turn rotated by transducer 19. Preferably, transducer 19 is an electric motor and gear box. For example the motor may be a brushed DC motor with a gear box ratio of approximately 1:200. The gear box ratio is selected so that the shaft preferably rotates (360 degrees) in approximately 2 seconds. This speed is sufficiently fast to allow the fill valve to close quickly when the target weight is reached to achieve the required accuracy.

The high gearbox ratio also allows a relatively small motor to produce sufficient torque to drive the camshaft. Another desired result of the gearbox is that when the motor is turned off, there is sufficient friction to prevent the camshaft from turning under the load from the valves. Alternatively, the valves 14,15 may be operated by separate cams 18, each in turn operated by a corresponding transducer 19.

Rotation of cam shaft 18 causes the opening and closing of the fill valve 14 and/or vent valve 15. The cam shaft 18 includes cam surfaces shaped to operate the valves in several sequences according to the angular position of the cam shaft. The cam shaft preferably has 2 control positions, FILL, VENT and two intermediate positions where both valves are closed. For example:

i) with the camshaft 18 in a FILL position, vent valve 15 is closed and fill valve 14 is open.

ii) with the camshaft 18 in a VENT position, vent valve 15 is open and fill valve 14 is closed.

The fill valve 14 has a cam follower 21 which rides directly on the top of the cam 18. The cam follower has a pin 22 which passes through the valve orifice to push the valve seal off the seat. The valve is arranged in this way so that the gas pressure from the supply bottle acts to close the valve to give a reliable seal. A return spring 23 is provided to overcome friction and ensure that the valve closes when the cam is lowered.

In the vent valve 15, the valve seal is attached directly to the cam follower 24. The cam follower has a slot 25 through which the cam shaft 18 passes, to allow the cam follower 24 to be actuated from the bottom surface of the cam. A return spring 26 is provided to overcome friction and the weight of the cam follower to ensure that the valve closes when the cam is raised. The valve 15 is configured so that the pressure from the canister 3 holds the seal closed.

FILL Position

With the high point of the cam (acting on fill valve 15) in the upper position, the fill valve 15 is pushed up to open. At the same time, vent valve 16 is pushed by the spring to close. Carbon dioxide will therefore flow through the fill valve in to the canister, with no venting to atmosphere.

Intermediate Closed Position

As the camshaft 18 is moved through 90 degrees, the peaks of the cam 18 are positioned horizontally. In this position, both the fill valve 14 and vent valve 15 close. When in this position, the supply bottle and the canister 3 are both sealed.

VENT Position

As the cam shaft 18 is moved through a further 90 degrees, the peaks of the cam shaft are positioned in their lowest point (i.e. downwards). In this position, the fill valve 14 is closed due to the force of the return spring 23 and the supply bottle pressure, while the cam follower of the vent valve will be pulled down, opening the vent valve.

Intermediate Closed Position

As the camshaft moves through a further 90 degrees the peaks of the cam are again horizontal. This allows both fill valve 14 and vent valve 15 to close. The supply bottle and the canister are both sealed.

The position of the cam shaft 18 is determined by the controller via a disk including a magnet at each valve position. The magnets are detected by 3 hall effect sensors, one for each of the FILL position, VENT position and one for both CLOSED positions. It will be appreciated that other methods may be used to allow the controller 2 to confirm the angular position of the cam shaft 18. For example,: via limit switches, or a rotary encoder etc.

One important advantage of the cam shaft and geared motor arrangement is that when the cam shaft (and valves respectively) are in any of the 4 positions, no power is consumed to maintain that position and the corresponding condition of the fill valve 14 and vent valve 15. This arrangement is ideal for the preferred battery operation allowing maximum portability and ease of use and maximizing electrical efficiency. The peak torque required from the motor comes when the fill valve is opened and the cam needs to overcome the force due to the pressure from the supply bottle acting over the orifice of the valve. The high gearbox ratio chosen for the motor enables a relatively small and low cost motor to achieve this torque. It will be appreciated that other types of motor/actuator arrangements are also possible for rotating the cam (or cams).

One other feature of the cam shaft is that it has a seal at both ends. This is to ensure that the pressure of the carbon dioxide does not act on the end of the shaft so that the forces are balanced so that there is no end thrust.

With particular reference to FIG. 3, the bottle 3 is preferably hung from the end of a weighing arm 27 via fill hose 8. Weighing arm 27 pivots at or near one end (not shown) and preferably transfers load to a load cell sensor 28 via a spring 29. The spring 29 provides a small amount of deflection of the arm under load and allows the use of a fixed stop to limit the load that can be applied to the load cell. This arrangement provides a degree over-load protection for the load cell 28. In addition, the flexible hose 8 also allows the bottle to hang vertically thereby minimizing any weighing error if the system 1 is not clamped exactly horizontally.

One advantage of the weighing arm arrangement is that any loads due to knocks or pulling sideways on the bottle, are transferred into the frame of the device and do not overload the load cell 28. Any small amount of friction in the pivot of arm 27 will only have a negligible effect on the measured weight, due to the relatively long length of the arm.

The hose 8 from the fill valve 14 to the canister 3 runs along the length of arm 27. This hose 8 passes from the fixed valve 14 to the moving end of the arm 23, so any stiffness or residual strain in the hose 8 could apply a load to the load cell 28 resulting in potential error to the weight reading. To mitigate this, the hose 8 is preferably as flexible as possible. For example, the hose 8 may have a nylon core with braided polyester reinforcement and a polyurethane outer layer for protection. The length of hose 8 between the fixed end and the end of the arm is preferably maximized so that the force produced by flexing the hose is as small as possible.

The filling system 1 is preferably small and lightweight so that it can easily be moved from place to place and facilitate onsite refilling of portable pressure vessels 3.

Typically, portable pressure vessels 3 come in a number of standard sizes. For example, typical canisters may be a 12 oz bottle, a 20 oz bottle or a 40 oz bottle. Pneumatic devices are typically designed to operate with these standard size bottles. However, while the fill weight is typically fixed, the weight of an empty 20 oz bottle for example, may be quite different between manufacturers. That is, a number of manufacturers may make 20 oz bottles (i.e. designed to received 20 oz of fluid), but the weight of the empty bottles may vary considerably between manufacturers.

Portable bottles are usually filled until they reach a target weight and therefore it is important to know the empty bottle weight accurately. Otherwise dangerous overfill conditions may result. In order to achieve this, the filling system 1 initially conducts a "tare" process. Alternatively, the controller may be programmed via a user interface with the known tare weight of a bottle 3 to be filled.

Tare Process

The first step of the filling system is to use the user interface 11 to select a desired fill weight. Preferably, the user interface 11, buttons 13 and display 12 are used to select a vessel size to be filled. With this information selected, the controller can set various parameters as appropriate for the selected bottle size as described in more detail later.

When initially connected to the filler system 1, and the fill process initiated, the controller 2 preferably enters a "tare" process and vents all the contents of the canister 3 to atmosphere. If the portable canister was initially quite full, prolonged venting will likely cause freezing of the valve and/or contents of the portable canister. Therefore, while the frozen contents prevent carbon dioxide being vented to the atmosphere, the bottle may still be far from completely empty. This could result in a dangerous overfill, if the vessel is presumed empty, when it is not.

Figure 7:
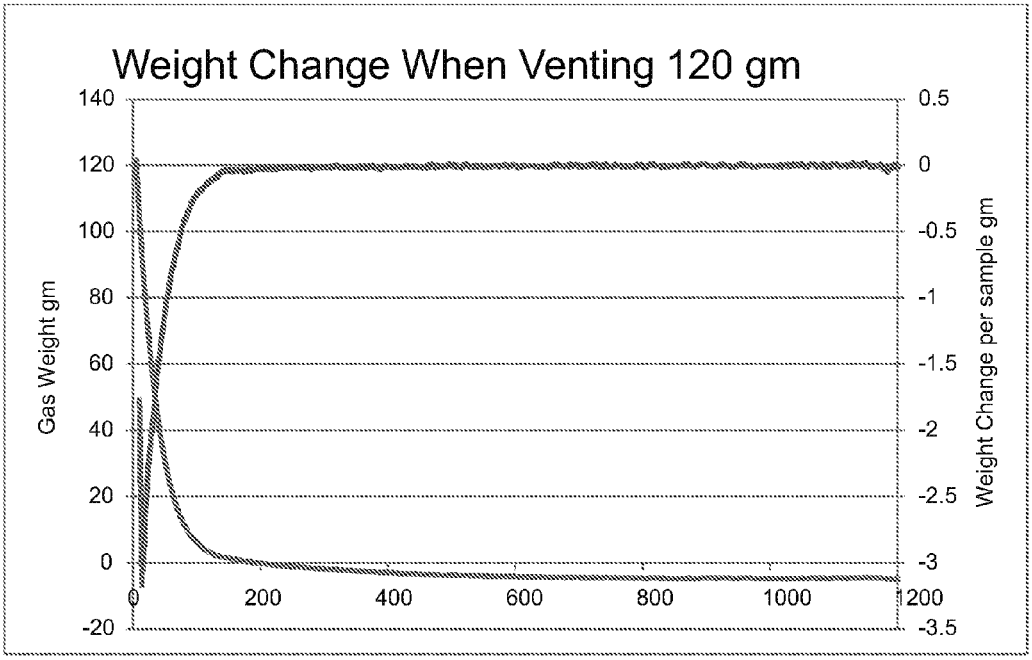
FIG. 7 is a typical graph of gas weight and rate of change of gas weight during an emptying cycle.

Controller 2, therefore preferably monitors the weight of the canister during the initial vent cycle. If the rate of change of weight drops below a first predetermined threshold, the canister is presumed empty, and the controller will initiate the filling cycle. This criteria ensures that the pressure vessel is close enough to completely empty to eliminate over fill risk, while preventing the potentially unduly long time period before absolutely all the gas is vented. FIG. 7 illustrates a typical graph of gas weight and change in weight per sample vs time when venting.

The first predetermined threshold is dependent on the restriction of the vent valve and so may vary depending on the detail of the valve design. The first predetermined threshold of weight change is preferably selected to allow confidence that the portable canister 3 is essentially empty, while making sure the initial vent cycle is not unduly lengthy.

For example, it has been found that a predetermined threshold of between 0.005 and 5 g per second is adequate. More preferably, a first threshold of between 0.01 g per second and 1 gm per second works well. Most preferably, this first threshold is approximately set to 0.067 g per second.

In order to implement this initial venting step, the controller 2 samples the output signal from the load cell 28 every 300 milliseconds, for example. Therefore, a predetermined threshold of 0.067 grams/s can be expressed as a change of less than 0.02 grams between two consecutive samples. It will be appreciated by those skilled in the art that there are many other techniques for measuring and implementing the pre-determined threshold rate of change for determining when the initial vent phase should be terminated according to the invention.

In order to avoid a situation where prolonged venting of the portable canister causes freezing, (and as a result the rate of change of weight falls below the first predetermined threshold), the filling system 1 limits the amount of continuous venting. If the limit is reached, the controller 2 generates an error signal and alerts the user via display 12 and/or an audible alarm etc. In addition, after such an error signal is activated, the controller may require the user to remove the portable canister from the filling apparatus in order to reset the controller.

This preferred lock-out step requires the user to assess the pressure vessel for freezing before reconnecting it to try filling again. Once reset, the controller will start from the beginning of the process and initiate another initial vent and tare process until the vessel 3 is empty.

Once the controller has determined that the vessel 3 is empty, (by confirming that the rate of change in weight has dropped below the first threshold and not encountering a venting limit), the tare weight is established from the load cell reading. This empty vessel tare weight, can then be used to fill the vessel to a target fill weight.

It is preferred that the user is given an opportunity to store the 'Tare' weight of the vessel 3 in memory for later use. For example, each vessel 3 may be given a unique identifier (e.g.: name, number etc) that can be stored in memory against the appropriate fill settings (such as tare weight and/or vessel fill weight). The next time that same vessel 3 is required to be filled, it can be selected via the user interface 11. When selected, the appropriate settings are retrieved from memory by the controller. For example, individual vessels 3 can be assigned a number (e.g. between 1 & 20) and the controller can store the settings in non-volatile memory. The controller may have any number of memory storage and the user interface may be simple or a full screen type.

Importantly, the initial tare process does not need to be executed by the controller when filling a 'known' vessel 3. Accordingly, if the vessel 3 is not completely empty, there is no need to waste the $CO_2$ within (or time), and the vessel can be topped up to its desired fill weight because the controller can retrieve the tare weight from memory.

Freeze Prevention

To implement 'freeze prevention', the controller 2 preferably also monitors the total weight change of the portable canister 3 during the initial vent phase. If the total weight change exceeds a second predetermined threshold, the controller triggers an error (and may also require a user to remove the bottle in order to reset the system and allow any filling). The controller, can preferably detect when the bottle is removed by monitoring the load cell (or any other suitable method), e.g. after receiving an error signal as described above, the controller will not allow the cam to rotate to the fill position unless the load cell has detected no load for a period of time. After re-connection, the load cell will register a non-zero load and the cycle can begin again.

According to one embodiment, the second predetermined threshold is preferably a maximum change in weight that is dependent on the portable canister size selected. For example, the maximum allowable weight change may be a percentage of the fill weight for the selected canister 3. Preferably, the second predetermined weight threshold is between 10% and 30% of the vessel fill weight. i.e. 4.0 ounces for a 20 ounce portable canister, (being 20%).

Alternatively, according to another embodiment (or in addition to previous embodiments) the controller may limit the maximum time the initial vent cycle is allowed to continue. If the rate of change of mass of the portable canister does not fall below the first predetermined threshold within a maximum time limit, the controller triggers an error signal, and may additionally require the user to remove the bottle and reset the controller. It is preferred that unless this (removal and re-connection) is done by the user, the controller will not allow any further filling. For example a time limit of 30 seconds may be set for all vessel sizes. Alternatively, the time limit may be determined with reference to the vessel size such that different time limits are applied to different size vessels.

In a further alternative, the controller may implement more than one limiting criteria on the initial vent cycle in the event that the rate of change of mass does not fall below the predetermined first threshold. That is, the controller may monitor a maximum time and a maximum change in weight and trigger an error signal if either criteria is met.

Filling Process

Figure 8:
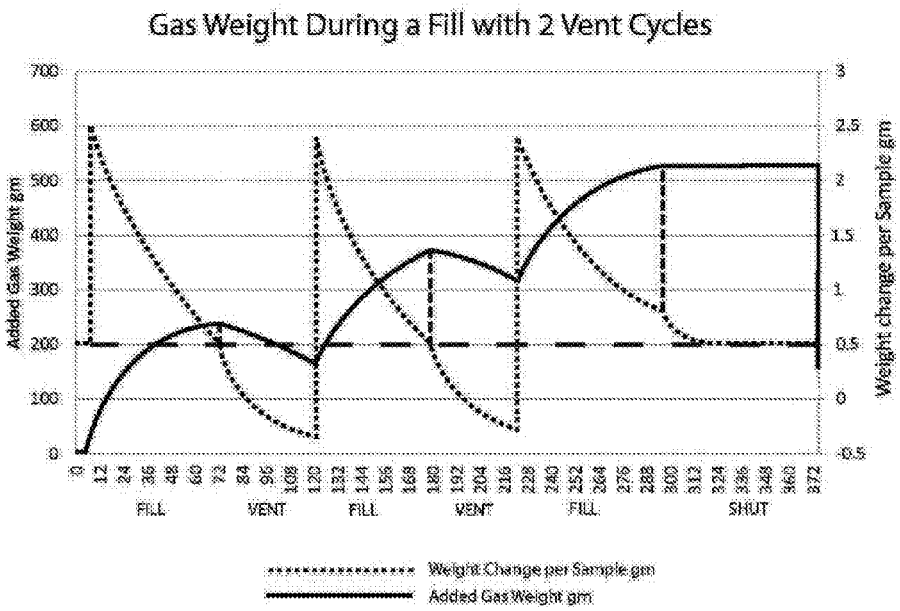
FIG. 8 is a graph of added gas weight and gas weight change over a number of fill and vent cycles.

The preferred filling process will be described with particular reference to FIGS. 8-9 and includes several example fill-vent cycles as noted earlier in order to reach the desired fill weight.

After completing the initial 'tare process' (or skipping it for a 'known' vessel), the controller can begin filling the vessel 3 to the desired fill weight. To do this the controller moves the cam shaft 18 to the FILL position where the vent valve 15 is closed and the fill valve 14 is open, so that $CO_2$ begins to flow into vessel 3. As $CO_2$ flows into vessel 3, the pressure within will increase and the filling rate slows and would eventually stop (often before the desired fill weight is reached).

The controller 2 monitors the output of the load cell 28 as the weight of vessel 3 increases. If the rate of change of weight of the vessel 3 falls below a third predetermined threshold, the controller moves the cam shaft 18 to the VENT position. The third predetermined threshold is according to one embodiment between 0.1 g/s and 10 g/s. Alternatively, and more particularly the third threshold may be between 0.5 g/s and 5 g/s. In the most preferred embodiments, the third threshold is approximately 1.5 g/s.

The venting of a small amount of $CO_2$ during filling, allows the temperature and pressure within vessel 3 to drop. As a result, the vessel 3 can be filled further. The controller monitors a fourth threshold for determining how long to vent the vessel 3 during filling.

According to one aspect, the fourth threshold is a predetermined change in weight of vessel 3. For example, the controller will cause the cam shaft to rotate to close the vent valve 15, after a predetermined reduction in vessel weight (since the vent valve was opened) has occurred, e.g. 20 grams. Alternatively, the fourth criteria is preferably dependent on the selected fill weight of the container e.g. a percentage or ratio such as 2% or 3.5% or 5%. In addition, it is anticipated that more than one fourth threshold may be applied. It is most preferred that at least one fourth threshold is a time limit. This is preferred to account for a situation where the supply source is empty, and the portable vessel 3 does not fill. In this situation, the change in weight (during venting) may never reach the fourth threshold level, and therefore a secondary time limit is useful to prevent the system from 'venting' indefinitely.

In a further alternative, the fourth predetermined threshold may be a fixed time e.g. 30 seconds (not dependent on vessel size). Alternatively the fourth criteria may be a fixed time that depends on the selected fill weight of the vessel.

In a still further alternative, the fourth predetermined threshold may be a rate of change of weight. e.g. if the rate of change of weight (decreasing), falls below a predetermined level.

Once the fourth predetermined threshold is satisfied, the controller moves the cam shaft 18 to the fill position, to allow further fluid (e.g. $CO_2$) to flow into vessel 3. As illustrated in FIG. 8, it may require several fill-vent cycles to reach the desired fill weight. The controller monitors the vessel weight and rotates the cam shaft 18 to a closed position (i.e. fill valve 14 and vent valve 15 closed), when the target weight is reached.

It is also preferable that the controller limits the number of vent then fill cycles. For example, if the vessel fails to reach its target weight after a predetermined number of cycles, the controller outputs an error signal (for example 7 cycles). This may occur for example, if the user inputs a container size and/or fill weight that is larger than the container or if the supply bottle is empty. In the case of an incorrect canister size, this error will alert the user to a potential overfill situation. The error signal may comprise an audible alarm and/or visual alert. In addition, the controller preferably moves the cam shaft 18 to the vent position to relieve the danger of an over fill.

Figure 9:
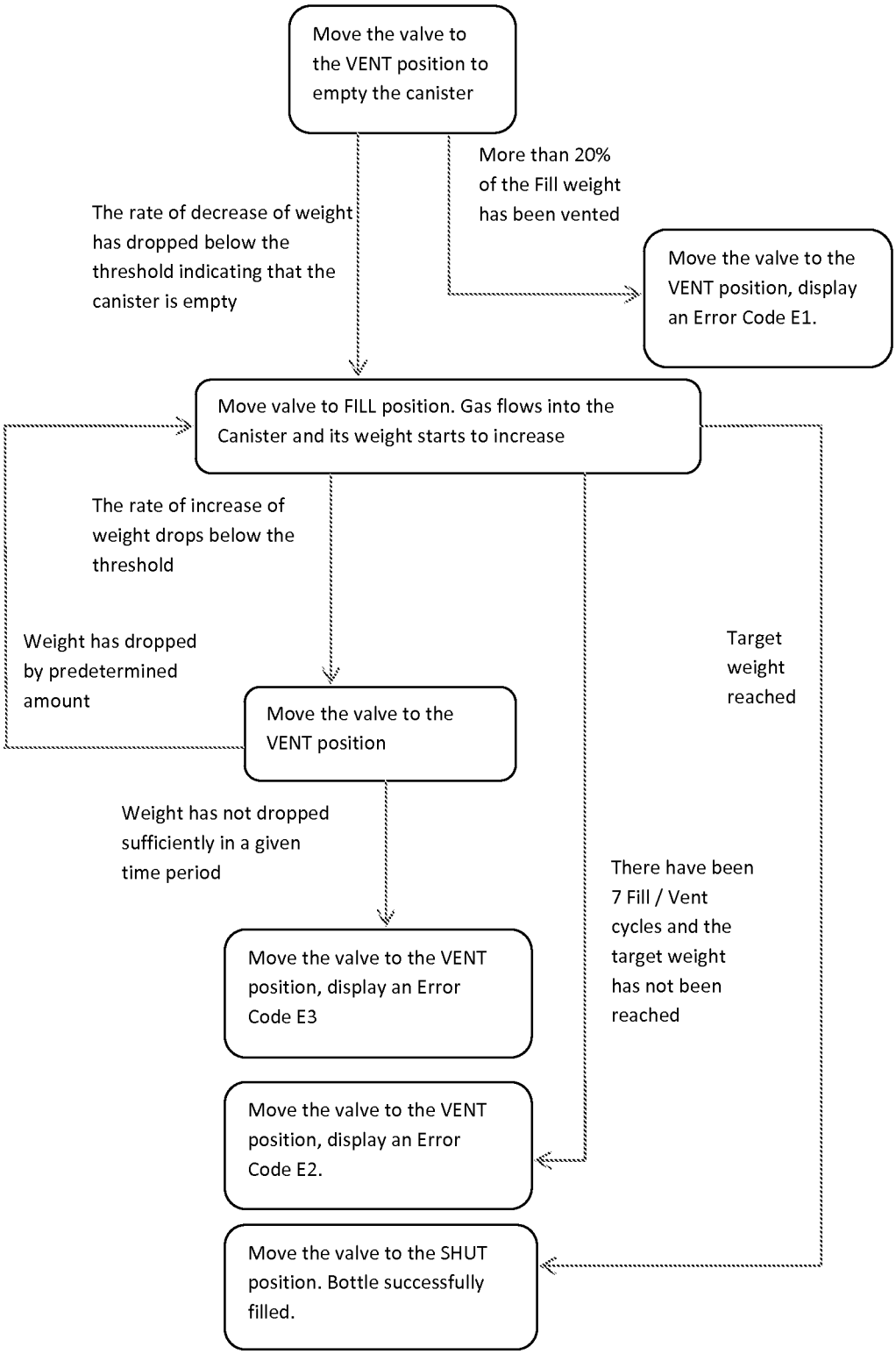
FIG. 9 is a flow chart illustrating the control logic of one embodiment.

The flow chart of FIG. 9, illustrates a preferred filling system process, as described above.

The foregoing description of the invention includes preferred forms thereof. Modifications may be made thereto without departing from the scope of the invention as defined by the accompanying claims.

The invention claimed is:

1. A filling apparatus for filling a vessel with fluid, comprising:

an inlet adapted to receive fluid from a pressurized source, an outlet adapted to connect to a pressure vessel, and a fluid pathway between said inlet and said outlet, a fill valve located in said path between said inlet and said outlet, a vent valve located in said path between said fill valve and said outlet, a controller operationally coupled to said fill valve and said vent valve, and adapted to receive a signal from a sensor indicative of the weight of said pressure vessel, and said controller includes a fill cycle wherein:

the controller causes the fill valve to open and the vent valve to close, and the controller monitors said weight signal over time to determine a rate of change in weight, and if a change in said weight signal indicates a magnitude of a rate of change of weight is below a third predetermined threshold, said controller causes said fill valve to close and initiate a pressure venting cycle.

2. A filling apparatus as claimed in claim 1, wherein during said pressure vent cycle the controller causes the vent valve to open, until a fourth predetermined threshold criteria is met.

3. A filling apparatus as claimed in claim 2, wherein said fourth predetermined threshold is dependent on an indicated size of the pressure vessel.

4. A filling apparatus as claimed in claim 2, wherein said controller causes said fill valve to open and said vent valve to close, after said fourth threshold is reached.

5. A filling apparatus as claimed in claim 4, wherein said controller causes said apparatus to execute a plurality of vent then fill cycles while the pressure vessel weight remains below a predetermined fill weight.

6. A filling apparatus as claimed in claim 5, wherein said controller causes said fill valve to close, said vent valve to open and outputs an error signal, if the pressure vessel weight remains below a said predetermined fill weight after a predetermined number of fill then vent cycles.

* * * * *